US005611195A

United States Patent [19]

Lovas et al.

[11] Patent Number: 5,611,195

[45] Date of Patent: Mar. 18, 1997

[54] DEVICE AND PROCESS FOR MAINTENANCE OF SPINNING DEVICES

[75] Inventors: Kurt Lovas, Bohmfeld; Bernd Bahlmann, Schrobenhausen; Hans Landwehrkamp, Lenting; Edmund Schuller, Ingolstadt, all of Germany

[73] Assignee: Rieter Ingolstadt Spinnereimaschinenbau AG, Ingolstadt, Germany

[21] Appl. No.: 467,042

[22] Filed: Jun. 6, 1995

[30] Foreign Application Priority Data

Mar. 8, 1995 [DE] Germany ..... 195 08 095.5

[51] Int. Cl.[6] ..... D01H 7/46; D01H 7/92

[52] U.S. Cl. ..... 57/264; 57/1 R; 57/300; 57/301; 57/406; 57/407

[58] Field of Search ..... 57/264, 300, 301, 57/302, 406, 407, 1 R

[56] References Cited

U.S. PATENT DOCUMENTS

| | | | |
|---|---|---|---|
| 3,977,168 | 8/1976 | Schewe | 57/1 R |
| 3,990,224 | 11/1976 | Grau et al. | 57/407 |
| 4,122,655 | 10/1978 | Anderson et al. | 57/407 |
| 4,516,396 | 5/1985 | Stahlecker et al. | 57/407 |
| 4,840,022 | 6/1989 | Karl et al. . | |
| 5,431,006 | 7/1995 | Schuller et al. | 57/406 |

FOREIGN PATENT DOCUMENTS

| | | | |
|---|---|---|---|
| 230569 | 5/1987 | European Pat. Off. . | |
| 534898 | 3/1993 | European Pat. Off. . | |
| 3432623A1 | 3/1986 | Germany . | |
| 3828730A1 | 3/1989 | Germany . | |
| 3810875C2 | 10/1989 | Germany . | |
| 4304088 | 8/1994 | Germany | 57/407 |

*Primary Examiner*—William Stryjewski
*Attorney, Agent, or Firm*—Dority & Manning

[57] ABSTRACT

A method and system for maintaining spinning machines having a plurality of spinning stations include automatically positioning a maintenance unit proximate to the spinning stations for removing spinning components from the spinning stations and replacing the removed spinning components with replacement spinning components. The maintenance unit is configured to remove the spinning component from the spinning station for servicing, to immediately replace the removed spinning component with a replacement spinning component which is carried by the maintenance unit, and to transfer the removed spinning component to a remote service station. The removed spinning component is serviced at the service station and is subsequently picked up by the maintenance unit for subsequent installation into another spinning station.

40 Claims, 8 Drawing Sheets

DEVICE AND PROCESS FOR MAINTENANCE OF SPINNING DEVICES

BACKGROUND OF THE INVENTION

The instant invention relates to a process for the maintenance of spinning devices by means of a maintenance unit which is able to travel alongside a plurality of identical spinning stations with spinning elements, as well as a device to carry out this process.

In the course of the spinning process, instances always occur in which the spinning rotor, the rotor cover covering the spinning rotor or the yarn draw-off nozzle must be replaced in adaptation to different materials because, for example, of increased occurrences of yarn breakage or because of the appearance of Moire effects in the spun yarn. In practice, the affected spinning station is stopped for this purpose. The parts to be checked or replaced are then taken out. Until the checked part or the part or parts to be replaced are installed again, a more or less long period of time goes by, depending on the volume of inspection or replacement tasks. During this period, the affected spinning station is excluded from the operating process.

OBJECTS AND SUMMARY OF THE INVENTION

It is a principal object of the instant invention to create a process and a device by means of which particularly long maintenance tasks can be carried out on spinning elements without having to remove the affected spinning station for a long period of time from the production process. Additional objects and advantages of the invention will be set forth in part in the following description, or may be obvious from the description, or may be learned through practice of the invention.

These objects may be attained according to the invention in that spinning elements are taken out (together, in the form of components) by the maintenance unit at a spinning station and are exchanged against identical, already serviced elements which are installed in the stead of the spinning elements to be serviced. Removed elements are conveyed together by the maintenance unit to a service station and are serviced therein. They are brought, after maintenance, to one of the spinning stations assigned to the service station for joint replacement against elements of a spinning device to be serviced. In this manner the stoppage time of a spinning station is reduced to the time necessary to exchange the component or components including the spinning elements on which maintenance is to be performed against such components on which maintenance has already been performed. The stoppage time thus does not depend on how much time is required for the maintenance on the spinning elements which no longer function properly or which are needed for an inspection within a previously fixed cycle, since this maintenance is carried out outside the spinning machine.

The time needed for such an exchange is especially short if the spinning elements are not removed individually but as components, together with the housings etc. which contain them. Maintenance on the spinning elements can therefore be carried out without time pressure. In addition, maintenance on the individual elements is also facilitated by suitable arrangement of the elements that are to be serviced in a service station. The service station is independent of production conditions, which can greatly improve accessibility of these elements for maintenance. Placing the components to be serviced in a service station that is independent of production conditions offers the further advantage that different maintenance devices can be brought to the elements of the components within the service station which could not be brought to the spinning machine due to narrow space available. Such maintenance at the spinning stations is, generally, impractical since the spacial conditions would have to be modified so that maintenance equipment could either be installed in the machine for each spinning station or moved to each spinning station. Such use of space is, however, not currently acceptable in practice.

Even if all the spinning elements of a spinning device are removed, brought to the service station, serviced therein, brought back to their original place, and reinstalled at that time, improved maintenance conditions permit easier and more intense maintenance for the spinning machine on its spinning elements than was available in part practice. Full advantage of the invention is realized, however, when, in accordance to a preferred embodiment of the process according to the invention, a number of identical spinning elements exceeding the number of spinning stations are within a production/maintenance cycle and are assigned to the spinning stations to be serviced. The spinning elements may be advantageously brought to any spinning station.

Even if the spinning elements of a spinning station are distributed among several components, it is advantageous to take advantage of the production interruption which occurs during replacement of one component to also replace all the other spinning station components containing other such elements. Replacing all components at the same time permits preventive maintenance for those other components.

In order to ensure that the serviced components are in fact working properly after maintenance, it is advantageous to provide in another preferred embodiment of the process according to the invention for each serviced component to be tested in the service station before being re-installed at any spinning station. If malfunctions occur during this test run, maintenance is advantageously continued during a predetermined period of time at the end of the normal maintenance period. If the malfunction can still not be eliminated, the test run is stopped. Preferably the malfunctioning components are eliminated from the replacement cycle after a predetermined number of unsuccessful maintenance attempts and are replaced by perfect, identical components.

Independently of the maintenance tasks to be performed, the component is cleaned during maintenance as a final step in a preferred embodiment of the process according to the invention.

In order to trigger maintenance, errors occurring at a spinning station during spinning operation can be stored centrally and the replacement of the affected spinning device for maintenance can be initiated when a predetermined number of errors has been reached. In addition to, or instead of, triggering maintenance, it is also possible to provide for the operating time of the component or of the spinning device since its last maintenance replacement, and to initiate the next maintenance replacement when a predetermined operating time has passed. In an advantageous embodiment of the process according to the invention, the components to be serviced and/or which have been serviced are put in intermediate storage at the input and/or output of the service station. Thus the maintenance unit which carries out the exchange of the component(s) to be serviced against the component(s) which have been serviced need not wait to deliver the component(s) to be serviced to the service station and/or to pick up the component(s) which have already been serviced from the service station.

To carry out the above-mentioned process, provisions are made in a device for the maintenance of spinning devices by a maintenance unit travelling alongside a plurality of identical spinning stations, whereby each spinning device is provided with spinning elements contained in one or several components, for each component to be assigned a locking apparatus which can be opened and locked by the maintenance unit, for the maintenance unit to be equipped for each of the different components with an offsetting device to lift out the component released by the locking apparatus, to accept the component for transport in a receiving location provided in the maintenance unit, and for the transfer of a component located during transport into its position for installation at a spinning station in another receiving location provided for each component in the maintenance unit.

In a preferred embodiment of the present invention, in order to keep stoppage times for a spinning device to be serviced as short as possible, the spinning stations and the maintenance unit are assigned a greater number of components than there are spinning stations to be serviced by the maintenance unit.

Since maintenance measures are as a rule required only at long time intervals, the spinning stations assigned to a service station for maintenance could be distributed over more than one spinning machine for a better rate of utilization.

In order to avoid waiting time for the maintenance unit provisions may be made in another advantageous embodiment of the object of the instant invention for the service station to be provided with an intermediate storage at its input and/or at its output for the components to be serviced and/or which have already been serviced. Thereby, the maintenance unit can unload the components to be serviced at the service station before the service station might be able to start maintenance on the newly delivered component or components. For example, the service station may be committed to a maintenance procedure on a previously delivered component. Furthermore, because of storage at the output of the service station, the service station is able to start the maintenance work on an additional components even before the tool equipment has picked up a component which has already been serviced.

Depending on the type of the machine to be serviced, the spinning elements may be of varying design. It is especially advantageous if the interchangeable spinning elements comprise an open-end spinning element, a bearing for the open-end spinning element, an opener device to open a fiber sliver, and/or at least part of a feeding device to feed the fiber sliver to the opener device. The open-end spinning element, the bearing, the opener device and at least part of the feeding device are contained in at least one component that is interchangeable by means of the maintenance unit. With such a design, the invention the invention is especially easy to realize, whereby the spinning elements of a spinning device are provided, in addition to an open-end spinning element in the form of a spinning rotor, with a rotor cover which can also be exchanged by means of the maintenance device.

In another preferred embodiment according to the invention, the spinning elements comprise a spinning nozzle and/or a draw frame upstream from this spinning nozzle. In such a configuration, the invention may be utilized to advantage.

The service station is preferably provided with a bearing to receive spinning elements of different forms and/or sizes. In this manner spinning elements needed in case of changes in the spinning conditions are made ready in the service station. In the case of a rotor spinning machine to be serviced by the service station it is therefore preferable for the bearing to receive spinning rotors, rotor covers, opener rollers and/or draw-off nozzles.

The maintenance unit is also provided with storage, within which it may receive several identical components. Such storage may receive components which have already been serviced and are to be re-installed as well as components which are to be conveyed to the service station for servicing. The maintenance unit is therefore able to service several spinning stations before it must again return to the service station.

It is possible to store the interchangeable spinning elements in several components or units. Especially rapid replacement of a spinning device to be serviced against a spinning device which has already been serviced may be optimally achieved where according to a preferred embodiment of the invention, the exchangeable spinning elements of a spinning device are combined into one single interchangeable component.

Advantageously, each spinning station may be equipped with a yarn monitor monitoring the quality of the spun yarn. Additionally, the maintenance unit can be assigned by means of a control device to different spinning stations consecutively, in accordance with the position of the maintenance unit at any moment. In this manner, servicing of a spinning device may be arranged as a function of the quality of the spun yarn.

Certain tasks on a spinning device must be adapted to the spinning elements. Thus, for example, the fiber collection surface on a spinning element which is a spinning rotor depends on its diameter. For this reason, in an advantageous embodiment of the device according to the invention, components which may be installed at spinning stations are marked to indicate relevant data for spinning. Through these markings, for example, the automatic adjustment of a yarn reserve can be initiated.

Control of the affected spinning station can be rendered even more flexible according to the invention when each spinning station is or can be assigned a control device on the machine configured to communicate with the control device of the maintenance unit. The maintenance unit control device is provided with a memory into which the component data relevant to the operation of a spinning deice can be entered. Such data can be transmitted to the machine control device in connection with an installation of the component or components containing the spinning elements at a spinning station. The machine control device is thereby able to derive important controls for the spinning process and its start-up. For example, in addition to the size of a spinning rotor, it is also possible to store its form, the form of the outlet of a fiber feeding channel, the configuration of a yarn draw-off nozzle, etc. Thus, for example, a suitable yarn reserve may be maintained for piecing, and the piecing process may be carried out by determining piecing withdrawal as a function of the component data.

It is advantageous if, in accordance with yet another embodiment of the device according to the invention, each spinning station is, or can be, assigned a control device on the machine equipped with a time control device by means of which a signal calling for maintenance can be transmitted to the maintenance unit at the end of a predetermined time span. This call signal can be a call signal transmitted to the maintenance unit or an information signal which is detected by the maintenance unit travelling alongside the spinning machine on its round. The call signal triggers the stopping of the maintenance unit and the replacement of the spinning device at the affected spinning station.

Different designs are possible for the service station. For example, several independently operating maintenance posts may be advantageously provided in the service station. In that case it is advantageous for the maintenance posts of the service station to differ in design in order to carry out different maintenance tasks. It is furthermore an advantage if the service station is provided with a device, possible for each of its maintenance posts, for the cleaning of at least one of the spinning elements.

It is a further advantage if the service station is provided according to the invention with a test spinning station at which the spinning element can be put through a test run. In that case the test spinning station in an advantageous embodiment may be equipped with means to monitor the true running of a spinning rotor.

In an advantageous embodiment of the invention, the service station is provided with an intermediate storage to receive spinning devices or individual components of same which cannot be serviced even after several attempts, so that this spinning device or this component may be excluded from further utilization in the spinning machine.

The invention makes it possible in a simple and practical manner to carry out intensive maintenance of the spinning elements of a spinning device. In a preferred embodiment of the process and of the device according to the invention, significant production time savings are obtained. As time-consuming maintenance tasks are carried out independently of the spinning stations at a central service station. The service station may be provided with one or several identical or different maintenance posts which can operate either simultaneously or sequentially, depending on the type of maintenance tasks to be performed. Employing the present invention, the maintenance tasks can be performed more intensively because of better accessibility and because of the absence of time pressure, since the maintenance time does not affect the production output. The risk of accidents is also reduced because the maintenance tasks are not performed in proximity to continuously running drives of the spinning device which extend over a plurality of adjoining spinning stations.

Examples of embodiments of the invention are explained below in further detail through drawings.

DETAILED DESCRIPTION OF THE PREFERRED EMBODIMENTS

Figure 1:
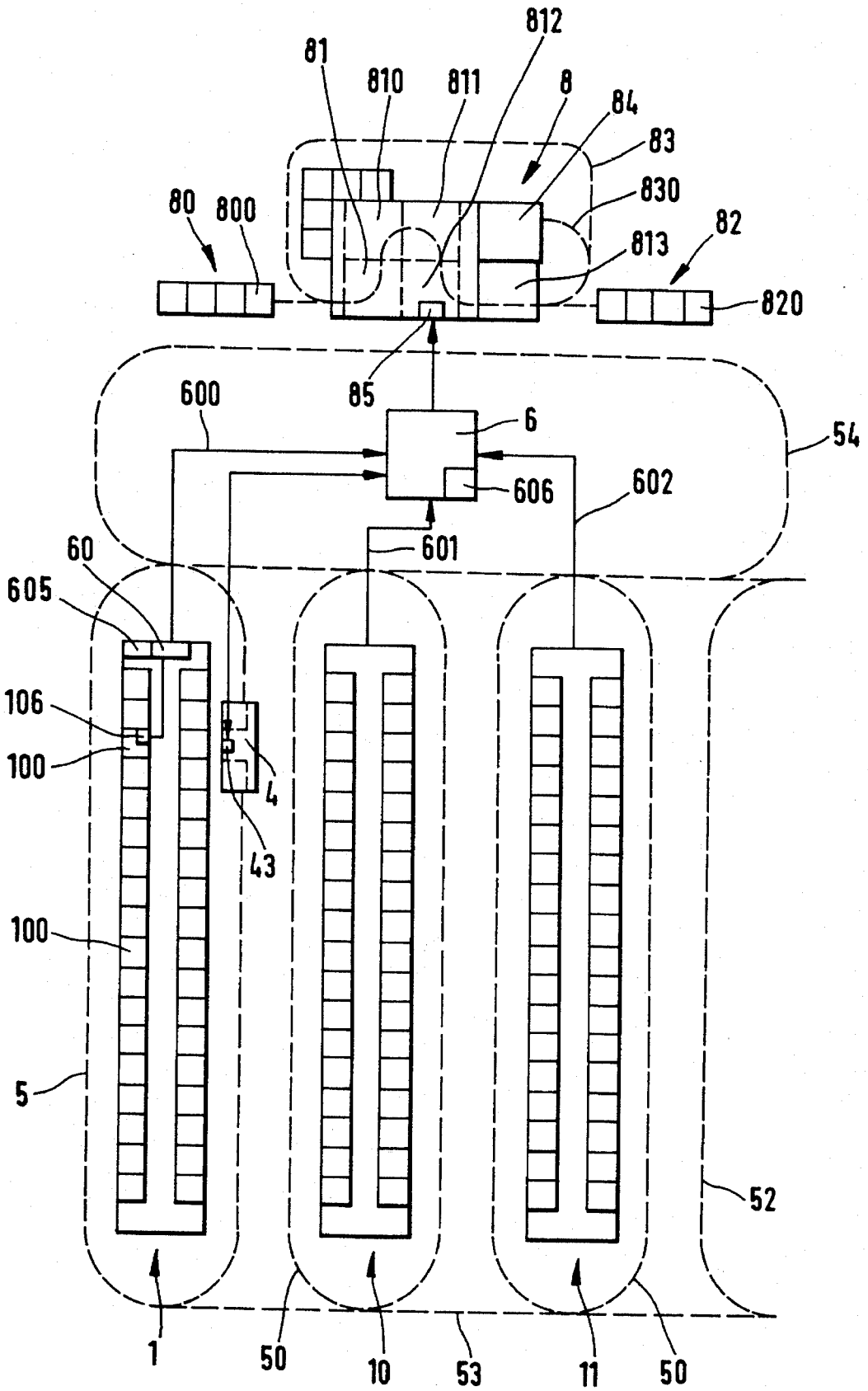
FIG. 1 schematically shows an installation according to the invention consisting of several spinning machines, a maintenance unit and a service station.

Reference will now be made in detail to the presently preferred embodiments of the invention, one or more examples of which are illustrated in the drawings. Each example is provided by way of explanation of the invention, and not as a limitation of the invention. In fact, various modifications and variations can be made in the present invention without departing from the scope and spirit of the invention.

The invention shall first be explained with the help of a schematic sketch. The schematic of FIG. 1 shows an installation with a plurality of spinning machines 1, 10 and 11 . . . , of which each is equipped at least on one longitudinal machine side with a plurality of identical spinning stations 100 adjoining each other.

The individual spinning stations of a spinning machine 1, 10, 11 . . . can be identical. In principle it does not matter whether the spinning machines of an installation are open-end spinning machines or air spinning machines or other similar machines. The spinning elements are then accordingly also different in design.

For the description below, a spinning device 2 is described with respect to an exemplary embodiment, spinning device 2 having as its most essential component a spinning rotor 20 (see FIG. 2). The spinning rotor 20 is preceded in the usual manner by a feeding device 21 consisting, for example, of a feeding roller 210 and a feeding trough (not shown). The feeding device 21 feeds a fiber sliver (not shown) which is to be spun to an opener device 22 which has as its most essential component a opener roller 221 contained in a housing 220.

The previously mentioned spinning rotor 20 is located in a housing 200 which can be covered by a rotor cover 23. The rotor cover 23 is mounted by means of a swivel axis 230 articulately on the housing 220 of the opener device 22 and contains, at least in part, a fiber feeding channel 231 which extends from the interior of housing 220. Housing 220 contains the opener roller 221 to the spinning rotor 20.

In the embodiment shown, the two housings 200 and 220 are connected to each other and thus constitute one single component 7 which furthermore supports the previously mentioned rotor cover 23.

The housing 220 lodges the opener roller 221 and the feeding roller 210, the bearing shafts of which support a drive gear 222 or a driving wharve 211 at their ends away from the opener roller 221 or feeding roller 210. The drive gear 222 or a drive wharve 211 are meshed with a toothed wheel 240 which is supported by a shaft 24 extending in the longitudinal sense of the machine. A drive belt 241 is connected to the drive wharve 211 and is held in contact against the drive wharve 211 by means of tension rollers 242.

The housing 200, which is connected to housing 220 so as to form one part, contains a rotor bearing 25 with, for example, a pair of supporting rings 250. The spinning rotor 20 is mounted with its shaft 201 in the nip of supporting rings 250. A drive belt 243 interacts with the shaft 201 and can also be lifted off from shaft 201 by a device which is not shown. Furthermore, a brake which is not shown can be presented to the shaft 201.

The entire component 7 described above is supported by means of a bearing 26 by the machine frame 260. The bearing 26 installed on the machine frame 260 may be provided with bearing bolts 261 on which the component 7 constituting the spinning device 2 is hooked, e.g. by means of a snap-on device (not shown).

In the shown exemplary embodiment, the machine frame 260 is provided below the spinning device 2 with guides 262 and 263 for a dirt evacuation belt 264. Dirt particles eliminated from the housing 220 through a dirt separation opening 265 accumulate on dirt evacuation belt 264 to be evacuated by dirt evacuation belt 264.

The housing 220 is provided on its side away from the machine frame 260 with a wall which extends into proximity of the guides 262 and 263 and supports a locking apparatus 3 which holds component 7. Component 7 includes feeding device 21, opener device 22, rotor cover 23, housing 200 with spinning rotor 20 and rotor bearing 25. In the operating position of rotor bearing 25, the drive gear 222 is meshed with the toothed wheel 240. The drive wharve 211 lies against the drive belt 241 and the shaft 201 of the spinning rotor 20 is held in contact against the drive belt 243. This locking apparatus 3 may consist of a housing 30 in which a stop bolt 31 is mounted elastically so that it snaps in behind the guides 262 and 263, i.e. on the side of guides 262 and 263 towards the machine frame 260. The stop bolt 31 is provided with an arm 32 which extends through a slit (not shown) in the wall of housing 220 towards the side away from the machine frame 260. Arm 32 pulls back the stop bolt 31 from the guide 262 or 263 in opposition to an elastic force so that the component 7 is released and can be swivelled around the bearing 26.

As shown in FIG. 1, a maintenance unit 4 can be caused to travel alongside those sides of the spinning machines 1, 10, 11, . . . which are provided with spinning devices 100. If each of the spinning machines 1, 10, 11 . . . has spinning devices 100 on both sides, the maintenance unit 4 must also be able to travel alongside both longitudinal sides of the machines. In a unilateral design of the spinning machines 1, 10, 11 . . . , the maintenance unit 4 travels only alongside the longitudinal sides of the spinning machines 1, 10, 11 . . . equipped with spinning devices 100.

The maintenance unit 4 travels alongside paths 5, 50, 51, 52 . . . , which are interconnected by paths 53. An additional path 54 leading to a service station 8 is connected to the path 53 and thereby also to the paths 5, 50, 51, 52 . . . .

Paths 5, 50, 52, 52, 53 and 54 may be of various suitable designs. Thus, these paths may be made in form of suspended rails or rails laid out in the floor. However, guides laid out below the floor which function without contact and which control the maintenance unit 4 by means of induction etc. are also sufficient.

In the example shown in FIG. 1, the actual service station 8 is preceded by a buffer storage 80 in which the components 7 to be serviced can be put in intermediate storage if the service station 8 is not yet ready to receive them. In the embodiment shown, the buffer storage is able to hold four components, but the number of the storage locations 800 in the buffer storage 80 do not matter. The service station has four service posts 81, 810, 811 and 812 in the embodiment shown, and these are traversed one after the other by the components 7 to be serviced. The spinning elements of the component 7 are, for instance, cleaned in the service post 81. In the service post 810 an exchange of the spinning elements may take place if it is determined, for instance, that different spinning conditions (e.g. yarn number) must be accommodated at the spinning station at which the component 7 is installed. At the service post, manual tasks may be performed on the component 7 as needed. At the service post 812, a mechanical inspection of the component 7 for complete assembly is performed.

At the output of the service station 8, component 7 undergoes a test run in service post 813. If the component 7 runs to satisfaction it is either directly transferred to a maintenance unit 4 located in the area of the service station 8 or is transferred to the buffer storage 82 on the output side. Maintenance unit 4 can then pick up the serviced component 7 from the storage locations 820 at a later time to convey it to a waiting spinning station 100.

If a test run has shown, however, that the component 7 still requires maintenance, the component 7 is again conveyed along path 83 to the input side of the service station 8 so that the component 7 reaches service post 81 again and goes through it completely.

If repeated maintenance does not lead to success, the component 7 concerned is conveyed along a path 830 to a storage 84 where similar components 7 are stored. An operator subsequently inspects the component to determine whether maintenance is still possible or whether this component 7 or parts thereof must be excluded completely from the maintenance circuit.

Now that the principle of the invention has been explained in essence, a more detailed description of a preferred embodiment of the maintenance unit 4 follows below. As shown in FIG. 2, the maintenance unit 4 is provided with arms 40 and 41. Each arm 40 or 41 is mounted on a swivel axle 400 or 410, which is made in the form shaft of a motor 401 or 411. At their ends away from the motors 401 and 411, the arms 40 or 41 are provided with receiving devices 406 (see FIG. 3) serving to receive the described component 7, which is provided with two bolts for that purpose. One of the bolts in the shown embodiment is constituted by the swivel axle 230 of the rotor cover 23, while the other bolt 27 is located in proximity of the bearing 26. The receiving device 406 may therefore be made in the form of a recess in the free end of arms 40 and 41 which can be swivelled up from below according to FIG. 2 so that they receive the bolt in form of swivel axle 230 as well as the bolt 27. Arms 40 and 41 thus lift the entire component 7 up and out of the bearing 26.

In order to be able to lift the component 7 out of the machine frame 260 it is necessary for the locking apparatus 3 described earlier to be unlocked. For that purpose, a two-armed lever 42 is pivotably mounted on the maintenance unit 4 in such manner that it pushes from below on arm 32 of the stop bolt 31 as shown in FIG. 2 and removes the stop bolt 31 from the guides 262 and 263. To enable the lever 42, which is mounted pivotably on a bolt 420 on the maintenance unit 4, to function in the manner described, its end away from the locking apparatus 3 is connected by means of a coupling element 421 to a drive 422. The drive 422 may be made as a solenoid for example. The coupling element 421 may constitute or contain the armature of this solenoid.

The two motors 401 and 411 are connected via control circuit 430 to a control device 43 which is installed on the maintenance unit 4. The drive 422 of the lever 42 is also connected to this control device via a control circuit 431.

When the complete unit is to be taken out for maintenance, the maintenance unit 4 stops before the spinning station concerned and swivels arms 40 and 41 in one movement in a clockwise direction from a rest position (not shown) within the maintenance unit 4 upwards. The ends (not shown) of these arms 40 and 41 receive the swivel axle 230 of the rotor cover and bolt 27 in a recess (not shown) in the free end of the arm 40 or 41. As the swivelling movement of arms 40 and 41 continues, the component is lifted up from the bearing bolt 261 so that the component can now be pulled into the maintenance unit by a transversal movement.

Depending on the configuration of the drive, it may not be sufficient for the arms 40 and 41 to be swivelled synchronously to lift the component from the bearing bolt 261. Such a lifting movement of the component may be prevented by the drives (e.g. drive shaft 24 with toothed wheel 240, drive belt 241, and drive belt 243). In the embodiment shown in FIG. 2, it is possible to provide for the arm 41 to be pulled first in the direction of the maintenance unit after reception of the bolt in the form of swivel axle in order to separate the shaft 201, the drive wharve 211 and the drive gear 222 from the drive belts 243 or 241 or from the toothed wheel 240. The lifting movement of the arms 40 and 41 is continued only when the component has been swivelled in a counter-clockwise direction so far around the bearing bolt 261 that, as the interrupted lifting movement is continued, the elements of the component can be moved unhindered past the mentioned drives (drive belts 243 and 241 as well as drive shaft 24 with toothed wheel 240).

Figure 4:
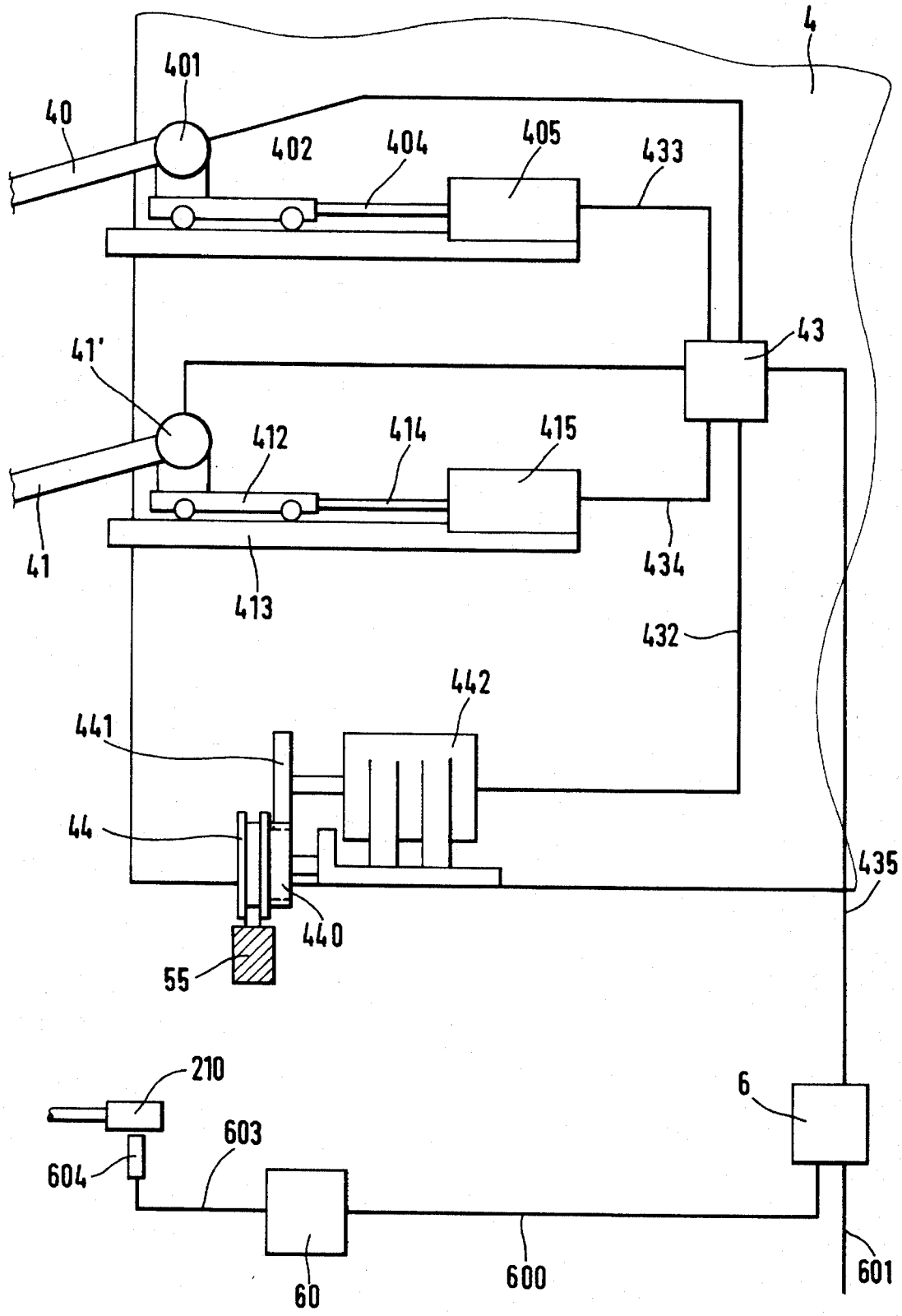
FIG. 4 shows a variant of the equipment shown in FIG. 3, in cross-section.

In the embodiment shown in FIG. 4, the maintenance unit 4 is able to travel on rails 55. For this purpose the maintenance unit 4 is equipped with wheels 44 by means of which the maintenance unit 4 is guided on the guide rails 55. Coaxially with wheel 44, a drive gear 440 is provided with which a driving pinion 441 which is linked. Driving pinion 441 is, in turn, driven by a motor 442. Motor 442 is connected via a control circuit 432 to the control device 43.

According to FIG. 4 each motor 401 or 411 is sitting on a carriage 402 or 412 which can be displaced on a guide rail 403 or 413 so that the arms 40 and 41 may be moved away individually from the spinning device 2. The carriage 402 or 412 is connected via a coupling element 404 or 414 to a suitable drive 405 or 415 which may be in the form of a solenoid or in the form of a pneumatic or hydraulic piston. The two drives 405 and 415 are connected for control via control circuits 433 and 434 to the control device 43.

The control device 43 is, in turn, connected via a control circuit 435 to a central control device 6. Control devices 60 of the individual spinning machines 1, 10, 11 . . . , e.g. spinning station 100, are connected with control device 6 as shown in FIG. 1. For this purpose, the different control devices 60 of the spinning machines 1, 10, 11 . . . , e.g. spinning stations 100, are connected via control circuits 600, 601, 602.

According to FIG. 4 the control device 60, for instance, is connected via a control circuit 603 to a scanning device 604 which ascertains the revolutions of the feeding roller 210. Impulses are produced in the scanning device 604, for example by the ribbing of the surface of the feeding roller 210. The number of impulses is therefore a measure of the revolutions of the feeding roller 210. The number of revolutions of the delivery roller is, in turn, a measure for the work time during which the spinning device 2 was in operation.

By means of the device shown in FIG. 4 it is possible to issue a control command to the control device 43 to stop the motor 442 when it next reaches the spinning station concerned after a predetermined operating time has passed (number of impulses transmitted by the scanning device 604 to the control device 60). The maintenance unit 4 stops at this spinning station and is positioned precisely across relative to the spinning device 2 by the usual devices (not shown), which should be understood by those of ordinary skill in the art. The locking apparatus 403 is now actuated so as to unlock the spinning device 2 through appropriate control of the drives 405 and 415, the motors 401 and 411, and the drive 422. As shown in FIG. 2, the component may be swivelled around the bearing bolt 261, then lifted off from the bearing bolt 261 by means of the arms 40 and 41, and pulled into the maintenance unit 4.

Figure 3:
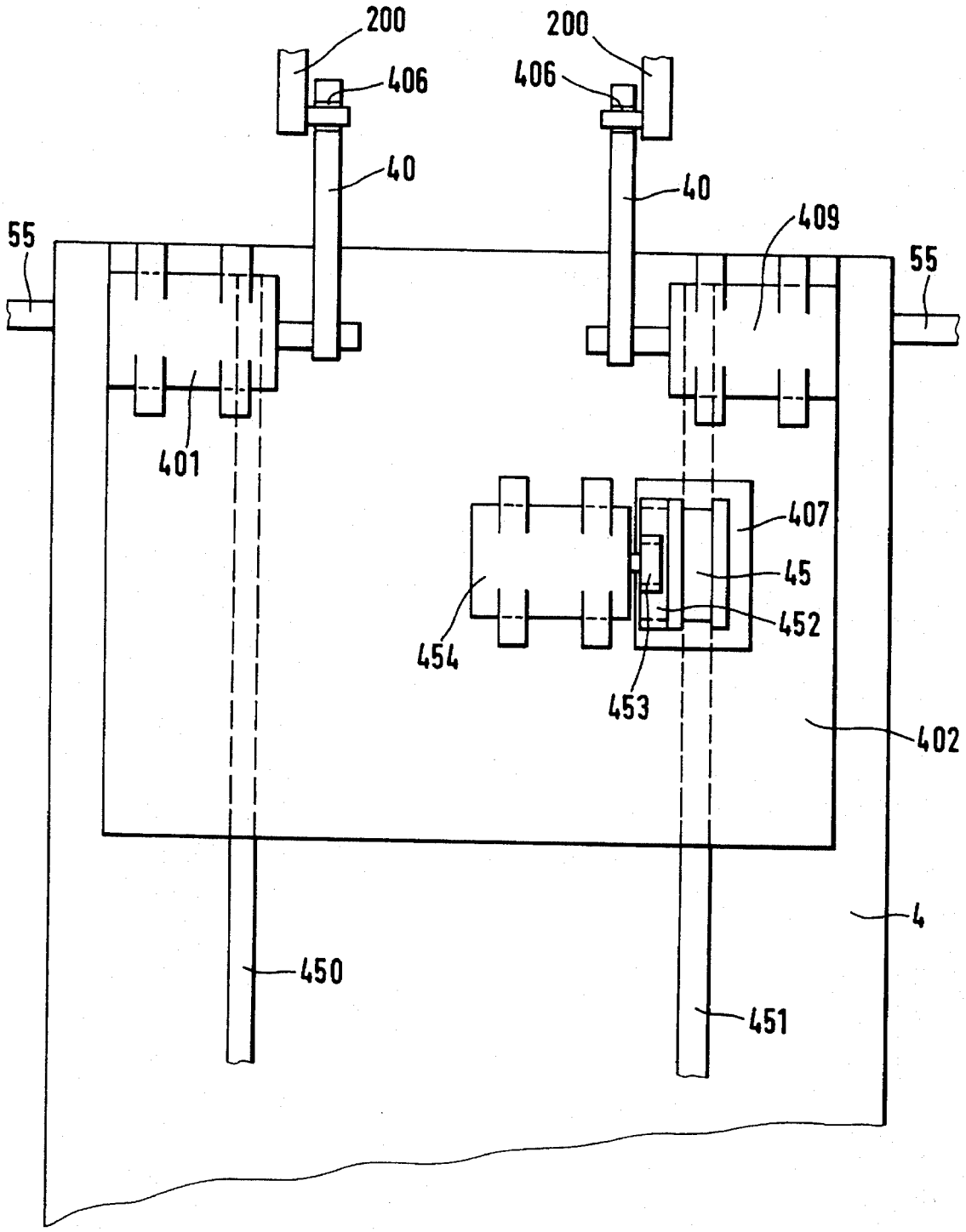
FIG. 3 shows a partial top view of a maintenance unit in accordance with the instant invention.

In the embodiment shown in FIG. 3, the maintenance unit 4 is provided with two rails 450 and 451 along which a carriage 402 is mounted so that it can be displaced. The carriage is provided with a recess 407 in its bottom plate. In this recess 407 is a drive wheel 45 which rolls on the rail 451. If necessary, the drive wheel 45 can be a toothed wheel, in which case the rail 451 is a toothed rack. A gear 452, with which a gear 453 driven by a motor 454 is meshed, is connected to the drive wheel 45. According to FIG. 3, and in addition to the arm 40, an additional arm 408 is provided which is driven by a motor 409 synchronously with motor 401 so that the arms 40 and 408 move synchronously.

Figure 2:
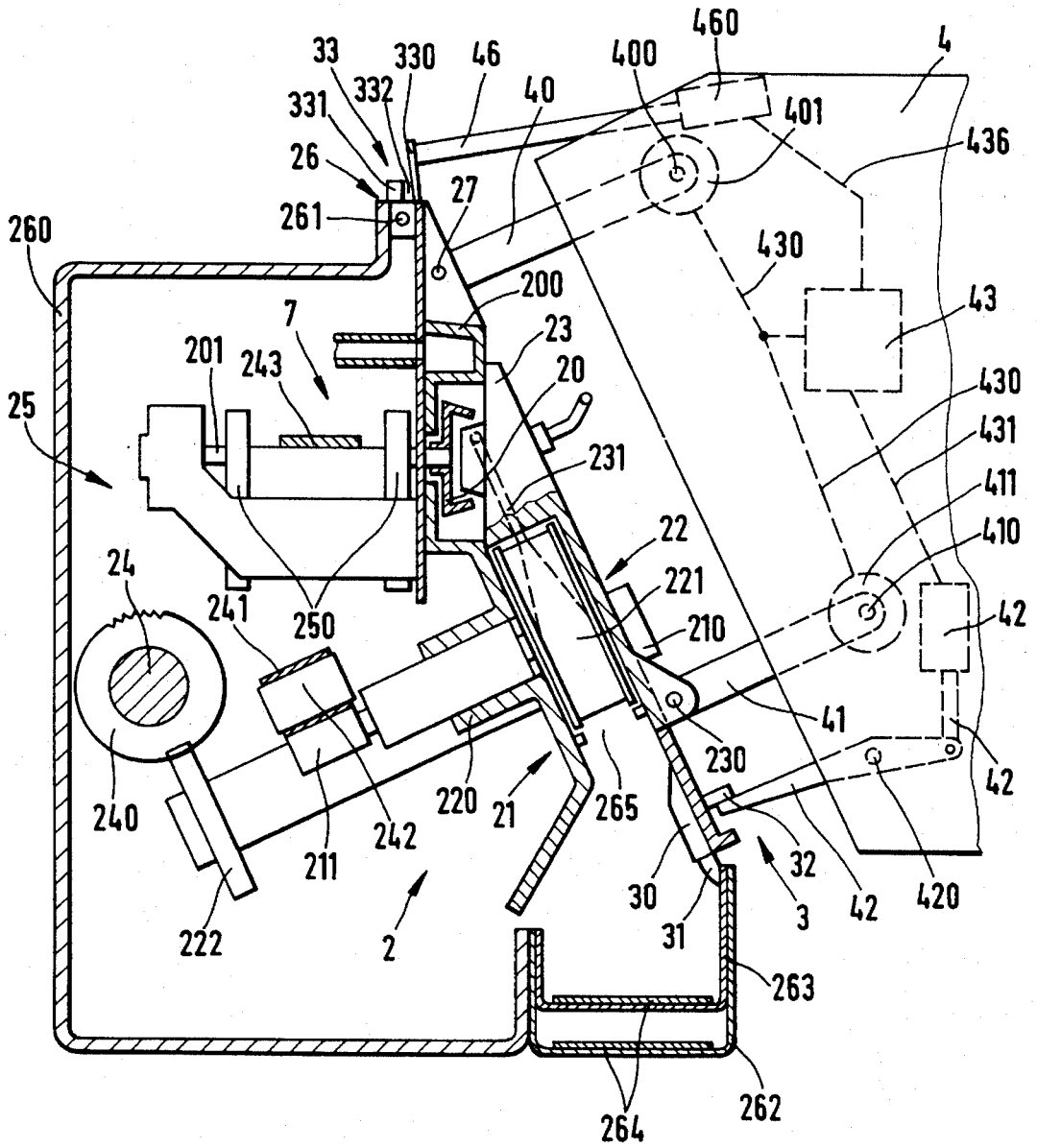
FIG. 2 shows in cross-section a spinning device of a rotor spinning machine with one single interchangeable component per spinning device as well as a maintenance unit designed according to the invention and interacting with this spinning device.

According to FIG. 2, the component 7 is not mounted on the bearing bolt 261 by means of a snap-in connection but by means of an opening and closing bearing arrangement 33. Bearing arrangement 33 is provided with an arm 330 which is held in a closed position by a compression spring 332 which bears upon an unmovable part 331 of the bearing. A ram 46, provided with a drive for this purpose, is connected to the control device 43 by means of a control circuit 436. Ram 46 can be moved to this elastically loaded arm 330 of the bearing 33.

In order to lift the component, it is therefore necessary first to open the locking apparatus 3 by means of drive 422. Then, after intervention of the arms, or of the arm 41, on the bolt constituted e.g. by the swivel axle 230, it is necessary to pull back the arms 41 in order to swivel the component 7 around the bearing 26 on the machine frame 260 and thereby to lift the driven elements of the component 7 from their drives (drive belts 241 and 243 as well as gear 240). The bearing arrangement 33 is then opened by actuating the ram 46. By swivelling the arms 40 and 41 in clockwise direction, the component 7 can now be lifted from the bearing 26 (bearing bolt 261). Once this is done, the carriage 402 is taken away from the machine frame 260 along the rails 450 and 451 by switching on the motor 454. The component 7 is then stored in the maintenance unit 4 for the continued travel of the maintenance unit along rail 55.

Figure 5:
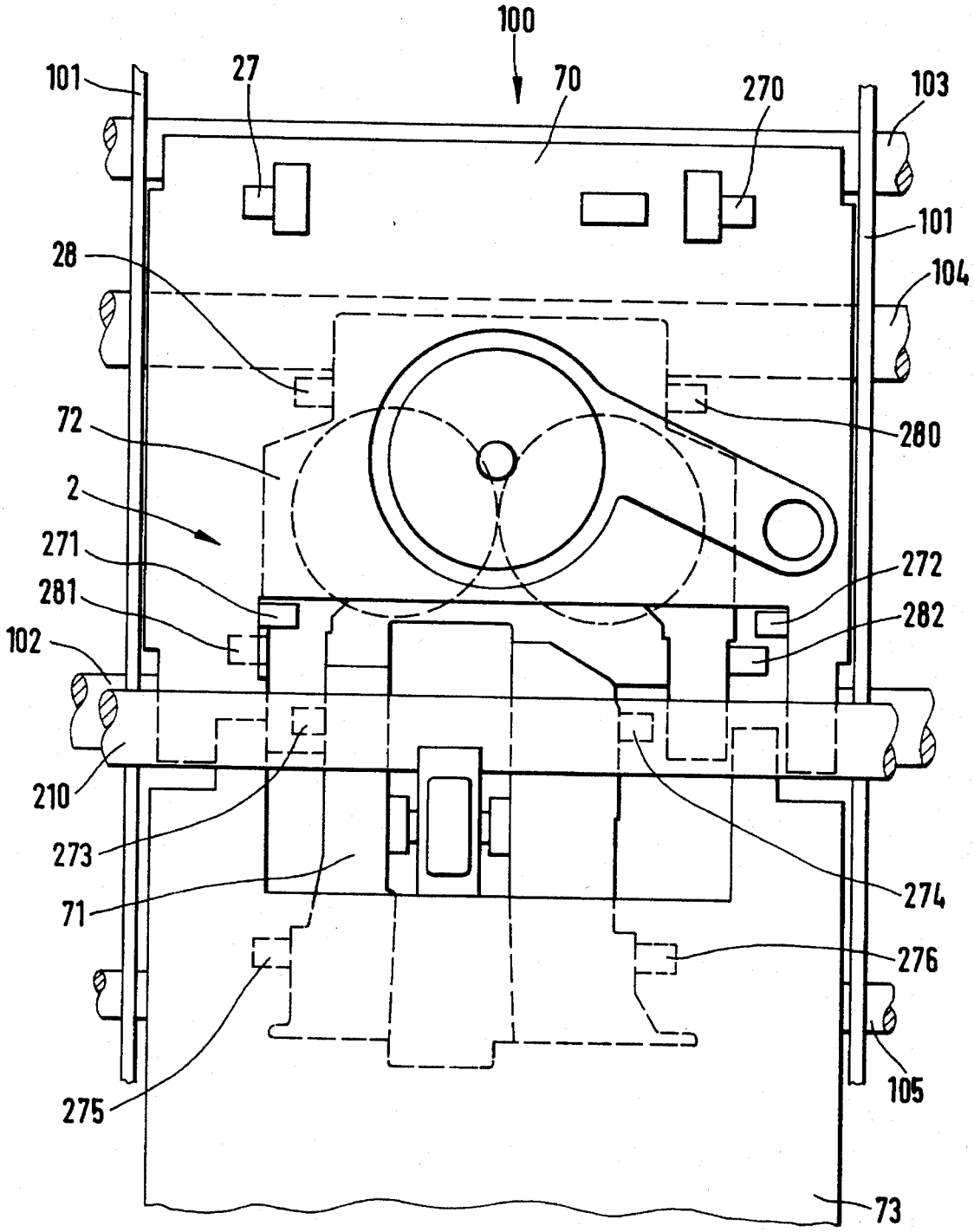
FIG. 5 shows a spinning device in a front view in which the spinning elements to be serviced are contained in several replaceable components.

FIG. 5 shows another embodiment of an open-end spinning device 2 in which the spinning elements are contained in several components 70, 71, 72 and 73. The spinning stations 100 are delimited on at least one side by intermediate walls 101 which support, as essential components, longitudinal components 102 and 103 to receive the component 70 containing the spinning rotor 20, an additional longitudinal component 104 which, together with longitudinal component 102, supports the component 72 containing the rotor bearing 25, and a longitudinal component 105 which, together with the longitudinal component 102, supports the component 71 containing the opener device 22. If the rotor cover 23 (see FIG. 2) is not installed on the component 71 containing the opener device, the rotor cover is also supported via another component 73 by the longitudinal component 102.

Figure 6:
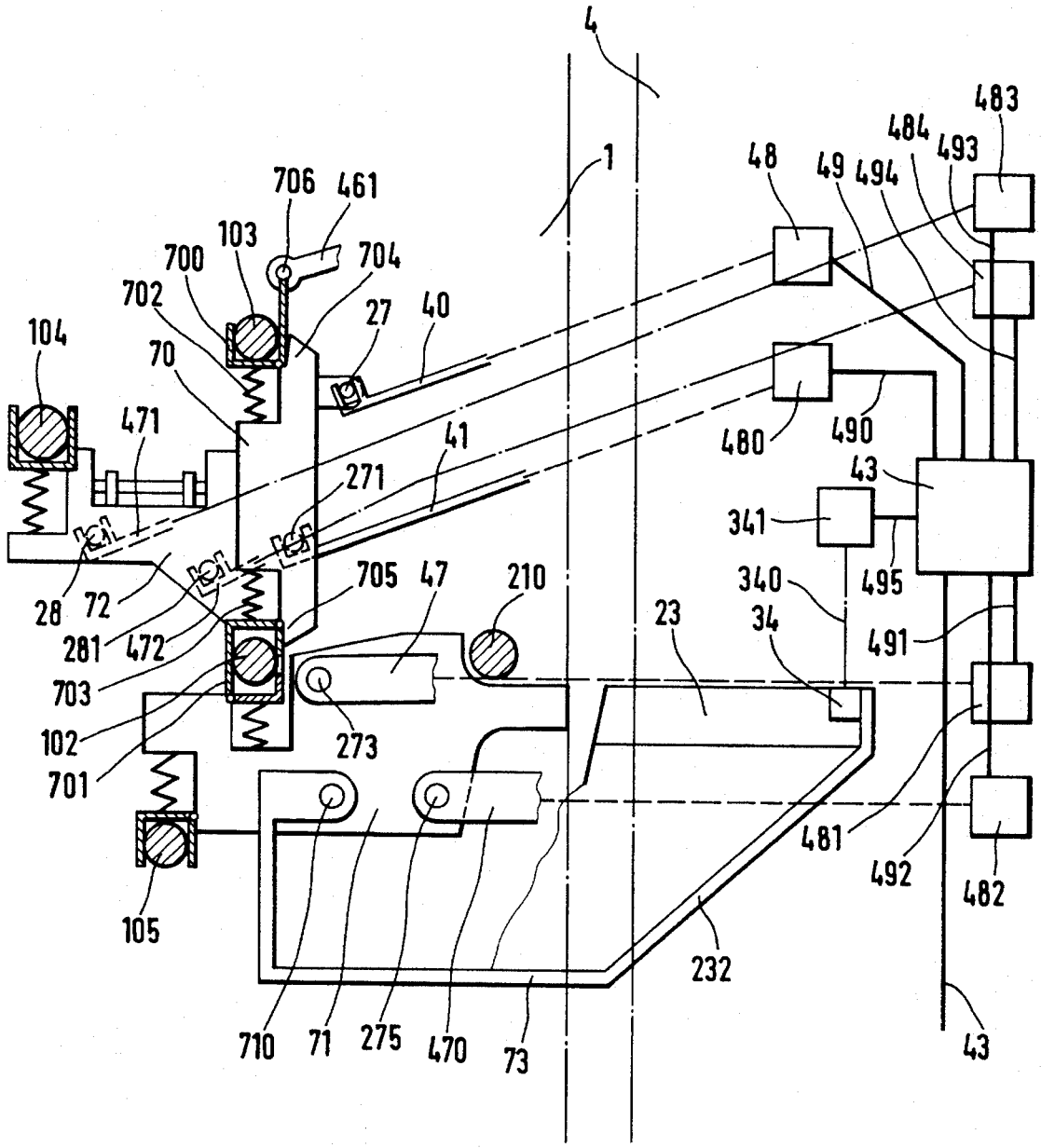
FIG. 6 shows a spinning device, slightly modified relative to FIG. 5, as well as the maintenance unit, in a schematic side view.

As shown in FIGS. 5 and 6, 2 pairs of bolts 27, 270 and 271, 272 are provided for the component 70, the arms 40 and 41 of which can be moved to the maintenance unit 4. The component 72 with opener device 22 is provided with two pairs of bolts 273 and 274 or 275 and 276 with which the arms 47 or 470, supported and controlled by the maintenance unit 4, interact. The component 72 containing the rotor bearing 25 is provided with two pairs of bolts 28 and 280 or 281 and 282 with which arms 471 or 472 can interact and which are also supported and controlled by the maintenance unit 4. Drive arrangements 48 and 480 are located on the maintenance unit for the control of arms 40 and 41. Drive arrangements 481 and 482 control arms 47 and 470, while drive arrangements 483 and 484 control arms 471 and 472. The drive arrangements 48 and 480 through 484 are connected via control circuits 49 and 490 through 494 to the control device 43.

The covering 232 supporting the rotor cover 23 supports a locking apparatus 34 which can be controlled by the means 340 shown schematically from a drive 341. Drive 341 is also connected for control via a control circuit 495 to the control device 43. The bearing arrangement for the individual components 70, 71 and 72 is shown schematically in FIG. 6 in the form of an elastically loaded bearing which holds the component elastically in its operating position. The schematic drawing shows on component 70 two exemplary fork-shaped mountings 700 and 701, each of which is held pressed against a stop 704 or 705 provided on the component 70 by a compression spring 702 or 703 bearing upon the component 70.

To set the housing with its fork mounting 701 on the longitudinal component 102, it is sufficient to push it on the longitudinal component without displacing the fork mounting 701. The fork mounting 700, on the other hand, may be presented an arm 461 of the maintenance unit 4 to bring the mounting into such a position that it can be pushed on the longitudinal component 103 by swivelling the component 70 around the longitudinal component 102. The arm 461 now releases the fork mounting 700, which is now held against stop 704 by means of compression spring 702.

While the arms 40, 41, 471 or 472 are provided at their ends with unilaterally open receptacles to receive the components 70 or 72 so that the corresponding bolts 27, 271, 28 and 281 can be received by their associated arms, it is necessary, for the reception of the component 71 by the arms 47 and 470 that these arms, without coming into contact with the bolts 273 or 275, be brought to the precise receiving level. Each arm, however, must be in axial continuation with respect to bolts 273 and 275 and brought close to the bolts 273 and 275 only after reaching this position in order to receive them in a hole-like receptacle.

In the same manner and as shown in FIG. 6, the reception of a drive bolt 706 is provided on the fork mounting 700 by means of arms 461 so that, in order to receive the drive bolt 706, they carry out an axial motion thereto.

It shall be assumed that the maintenance unit 4 has already replaced the components 70, 71 and 72 at a spinning station 100. Simultaneously with the replacement of component 71, a replacement of component 73 has taken place, since these are suspended by means of bolt 710 on component 71 as shown in FIG. 6.

Components 70, 71, 72 and 73 have been put in intermediate storage in a storage compartment B in the maintenance unit 4.

Figure 7:
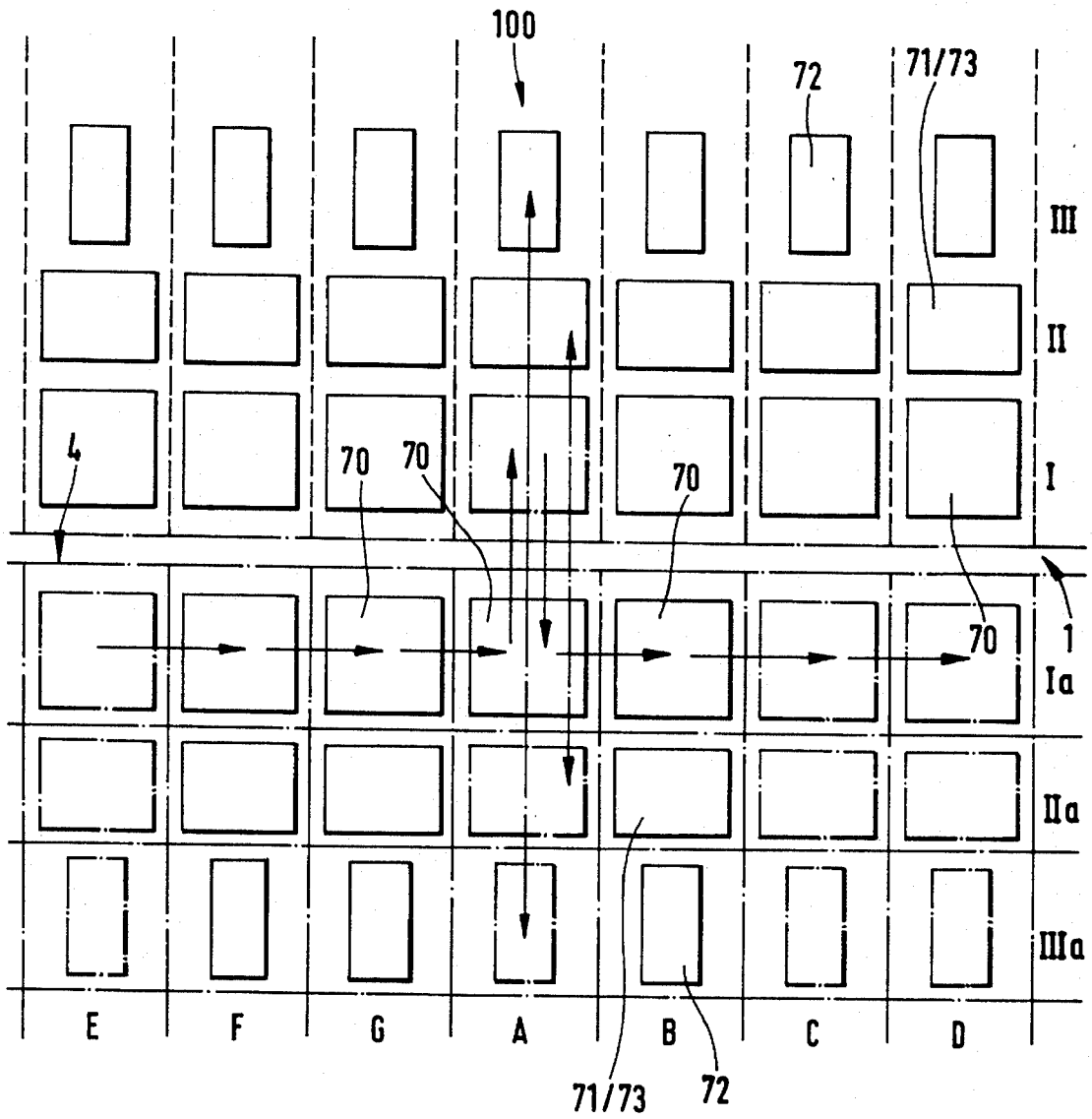
FIG. 7 schematically shows part of the spinning machine as well as part of the maintenance unit.

In the position shown in FIG. 7, the maintenance unit 4 is located with its working chamber A precisely across from the spinning station 100 to be serviced. Depending on the design of the components and on their suspension, and depending on which one of the components 70, 71, with 73 as well as 72 are to be serviced, the removal of the components and the installation of a replacing component proceeds in different sequences. For example, according to FIGS. 6 and 7, it is not planned for the components 71 with the component 73 in form of a covering 232 to be replaced. Instead, these components are to remain at the spinning station as before. It is therefore sufficient, by actuating the drive 341, to actuate the locking apparatus 34 of this covering 232, whereupon the covering 232 assumes the open position shown in FIG. 6 due to its own weight. The component 70 containing the spinning rotor 20 is now accessible. Through the intervention of arms 40 and 70 in the bolts 27 and 271, and through an appropriate movement of these arms 40 and 41, the component is pulled from the longitudinal components 102 and 103 and from the spinning station against the force of the compression springs 702 and 703. This state is shown in FIG. 7, in which the component 70 of spinning station 100 is already in the storage IA of the maintenance unit 4. In another operation, the component 70 in storage IA, which now contains component 70, is shifted from working chamber A into storage compartment B. The component 70 which had been there shifted into storage compartment C. The working chamber A is now free again. Component 70, which had been in storage compartment G, can thus be transferred into the working chamber A where it is received by the arms 40 and 41 and conveyed to the spinning station 100 to be installed there in the described manner. As the component 70 is shifted from storage compartment G into the working chamber A, another component 70 follows by sliding from working chamber E into storage compartment F.

On the maintenance unit, additional storage IIA is provided for the components 71 with 73. Additional storage IIIA is provided for the component 72. The operation with respect to components 71, 73 and 72 proceeds in the same manner as was described above in connection with storage IA.

When all the components of a storage have been replaced, all the storage compartments B, C and D are full. The maintenance unit must therefore travel to the service station at this time at the latest.

In the drawings, the designations I, II and II were used for the arrangement in the spinning machine 1, in analogy to the storage IA, IIA and IIIA. It should be understood that these units are not placed separately from each other as indicated in the schematic FIG. 7, but are in their normal operating position according to FIG. 6. As shown in FIG. 1, each spinning station 100 has its own spinning station controls 106 which are, as a rule, electronic. At each machine, the previously mentioned control device 60 is provided, to which the input device 605 for the input of technical spinning parameters, e.g. draw-in speed, yarn draw-off speed, motor speed, etc. is assigned. The control devices 60 of one or several machines are connected to a central control device 6 which is also provided with an input device 606. Control device 6 is able to set certain parameters centrally, e.g. preventive replacement of the component of a spinning station at the end of a predetermined time span or replacement of such components when a certain number of errors has been reached. Control device 6 exchanges data with the maintenance unit 4 or its control device 43 to inform the maintenance unit 4 which tasks are to be performed at which spinning station 100. Depending on its design, the maintenance unit 4 is able to ascertain at which spinning station it is located by counting the spinning stations 100 which it passes, or through control impulses transmitted from a given spinning station 100 directly to the maintenance unit 4. The maintenance unit 4 in turn informs the control device 6 of any difficulties in servicing the spinning station that may have occurred.

The control device 6 is furthermore connected to a control device 85 of the service station 8, which carries out maintenance on the delivered components in accordance with the commands received from the control device 6. Thus, for instance, the control device 6 may inform the service station 8 that a change of batch is to take place, for which spinning rotors 20 of different configuration and/or size, different rotor covers and different yarn draw-off nozzles are needed. The service station may be equipped with different service posts, depending on what type of work is to be performed in the service station 8. Thus it is possible to clean the spinning rotor 20, to check the rotor for true running after it has been cleaned, and to produce perfect true running by removal (milling). The spinning rotor 20 may be replaced in adaptation to the different materials to be spun. As a rule, it is then necessary to replace the rotor cover also, in adaptation to the spinning rotor. A replacement of the complete rotor housing may also be advantageous in order to ensure, independently of the currently used size of the spinning rotor 20, that the spinning rotor need move as little air as possible in its rotation, by surrounding it tightly with the circumferential wall of the rotor housing.

A replacement of the rotor cover may also be necessary when the spinning principle is to be changed, for example in that the fibers being fed to the spinning rotor 20 are not to be deposited directly on the fiber collection surface but are to be deposited on a surface which widens in the direction of the spinning rotor and is an integral part of the rotor cover.

In adaptation to the material to be spun, or in case of wear, it may also be necessary to replace the draw-off nozzle. When certain yarn characteristics (tightly or softly twisted yarns) exist, or in adaptation to the material to be spun, a replacement of the draw-off pipe may also be necessary under certain conditions.

By replacing the opener roller, adaptation to the material to be spun may also be achieved. During maintenance, vacuum cleaning may be helpful, even when nothing is to be changed on the opener roller housing. If the opener roller housing has a liner, the liner is subject to wear, and renewal may be necessary. A device may be provided on the spinning machines to aspirate fibers, even before they reach the fiber collection surface, in order to feed the fiber stream to the spinning rotor only at the beginning of the actual spinning process. This auxiliary suction typically has an opening in the circumferential wall of the opener roller housing which may become undesirably covered. In that case, a replacement of the housing by one without a dirt separation opening may be advantageous. The same result may also be attained, however, if the dirt separation opening already provided in the housing is covered by the earlier-mentioned housing lining. Additionally, by means of a suitable replacement of the opener roller housing, the spinning device can be given a configuration suitable for the production of core yarn.

Depending on the design of the feeding device, e.g. with an individual delivery roller provided for the spinning station 100 and a coupling per spinning station, these parts can also be replaced in the service station 8.

The spinning rotor in the embodiment shown is supported on pairs of disks which are provided with a coating subject to wear on their circumferences. Replacement of these disks is necessary from time to time so that the disks with worn coating may be given a new coating. Furthermore, an oil change may become necessary for the axial support of the spinning rotor 20. Other parts of the rotor bearing also require replacement from time to time.

With the tasks mentioned above, which can be performed from time to time, and the execution of which can be selected by the control device 6, it may also be necessary to perform maintenance on other parts besides the components. Among these may be a rotor brake (not shown) or the toothed wheel 240, which must be designed so that it can be taken off the drive shaft 24 without having to remove drive shaft 24.

The size of service station 8 depends upon what tasks have to be carried out. There may exist, therefore, more or fewer service stations 81, 810, 811, 812, 813, which are equipped with robot-like devices for performing maintenance upon, or for disassembling and subsequently assembling, components. It is not required that all tasks be performed automatically. It is possible that the service station 8 may have service posts where manual maintenance is performed before, between or after other service posts. These may be needed e.g. for disassembly and subsequent re-assembly of components when the connecting elements are in an especially unfavorable position and are therefore not easily accessible by automotive tools.

Figure 8:
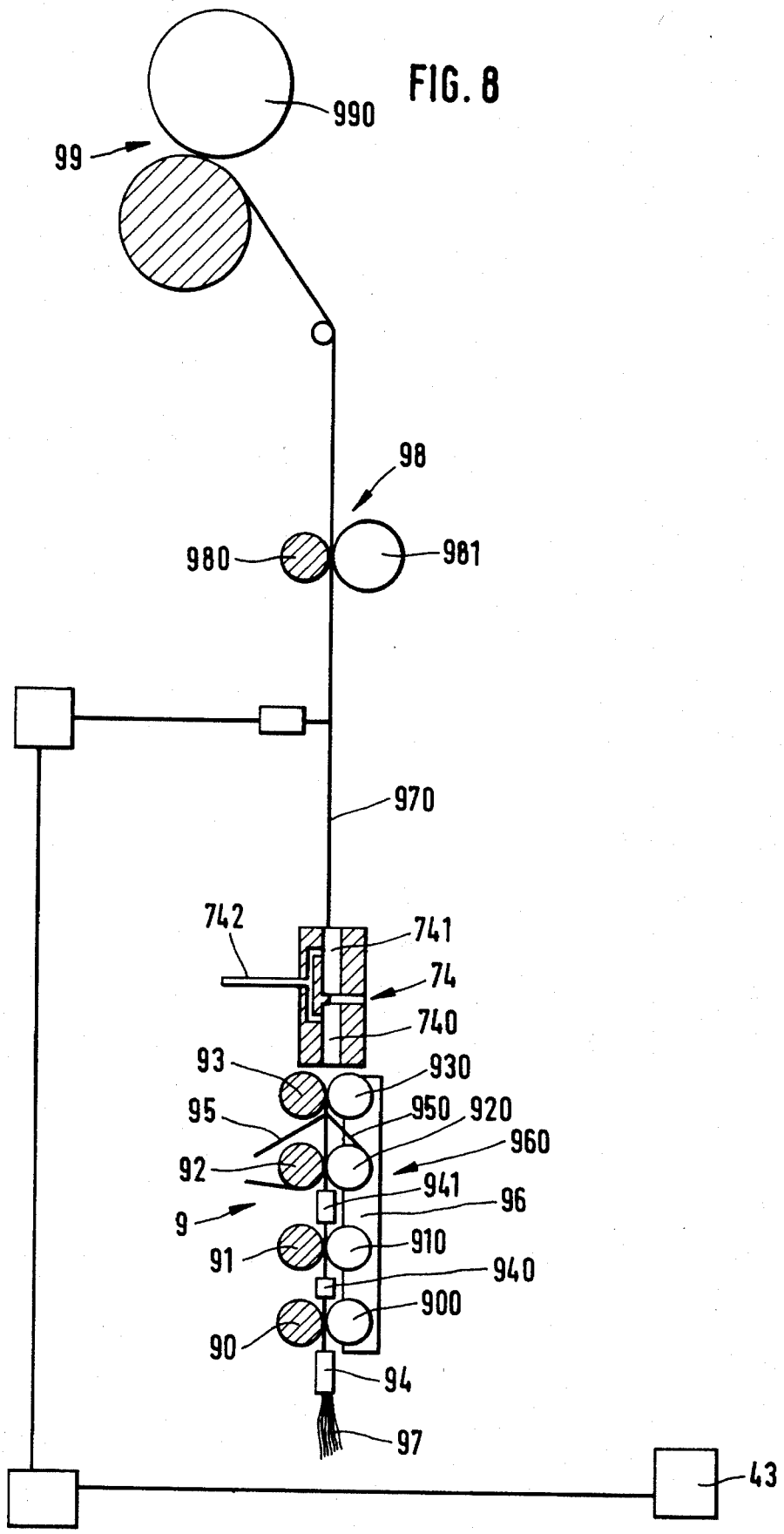
FIG. 8 shows in cross-section a spinning device of an air spinning device designed according to the invention.

A rotor spinning device was chosen above in an exemplary embodiment. The invention is, however, not limited to a rotor spinning device, but can also be used in combination with other spinning elements. Thus for example, FIG. 8 shows an air spinning device which is equipped with a draw frame 9 and a twisting element 74 as essential components.

The draw frame has four pairs of rollers 90 and 900, 91 and 910, 92 and 920, and 93 and 930. A condenser 94, 940 and 941 is located before the rollers 90 and 900 of the first pair of rollers, between the rollers 90, 900 and 91, 910 of the first and second roller pair and between the rollers 91, 910 and 92, 920 of the second and third roller pair. The two rollers 92 and 920 are each surrounded by a small belt 95 or 950.

The rollers 90, 91, 92 and 93 are stationary at the spinning station, while the rollers 900, 910, 920 with small belt 950 and roller 930 are supported on a bearer 96 which constitutes a component together with the rollers 900, 910, 920, 930 and small belt 950. It is possible to take out the component from the spinning machine as one complete unit in order to convey it to a service station 8 for maintenance and to subsequently re-install it as a complete unit at another spinning station. The component 960 is designed accordingly so that a locking device or similar device is opened when the component is to be taken out.

After taking out the component 960, the condensers 94, 940 and 941, which can also be taken out when necessary by means of a maintenance unit, are also accessible. The twisting element 74 again constitutes a component and contains two injector nozzle 740 and twisting nozzle 741 combined in this component. In the installation position the twisting nozzle 741 is connected via a compressed-air channel 742 to a source of compressed air which is not shown.

Additionally, these nozzles constituting a component (twisting element 74) can be taken out in analogous fashion. FIG. 8 shows the air spinning device in operation, during which a fiber sliver 97 is introduced into the draw frame 9, is drafted therein in the desired manner, and is spun in the twisting element into a yarn 970. Yarn 970 is drawn off from the spinning device by means of a draw-off device consisting of rollers 980 and 981 to be conveyed to a winding device 99 to be wound up on a bobbin 990.

The analysis of an error on separate spinning stations may also trigger utilization of a maintenance device according to the invention. Thus it is possible, in case of yarn breakage on a rotor spinning box, to draw conclusions as to the source of the yarn breakage based on the yarn segment last spun before the yarn breakage. Thus it is possible, for instance, to impute the source of error to the sliver trough or to the pneumatic fiber conveying system in case of a long, thinly running out yarn end. In case of a short fiber bunch which is not incorporated, the cause of error is to be found in the area of the opener or in the spinning rotor. The spinning element involved in each cause, and which is probably faulty, can then be replaced by the maintenance unit in a targeted manner. For this it is necessary to store the last spun segments of the yarn and their measurement data in a measured-value memory which is connected to a quality monitoring system. In case of yarn breakage, this signal can be intercepted and compared with a reference signal. Assigning the cause of error is then possible. With a suitable design of the components or of the spinning elements it is also possible, in addition to the described spinning elements, to replace draw-off nozzles or yarn draw-off pipes. It has been shown to be especially advantageous if the spinning elements tending to wear, or which must be exchanged when producing different yarn qualities, are placed in components that are easily exchanged by the maintenance unit. Yarn monitors, quality monitoring systems, and parts of the winding unit on which the yarn is wound up are also suitable for exchange.

It will be apparent to those skilled in the art that various modifications and variations can be made in the present invention without departing from the scope and spirit of the invention. For example, features illustrated or described as part of one embodiment can be used in another embodiment to yield a still further embodiment. It is intended that the present invention cover such modifications and variations as come within the scope of the appended claims and their equivalents.

We claim:

1. A method for maintaining at least one spinning machine having a plurality of spinning stations, each spinning station comprising plurality of spinning components and including one or more removable components employed in spinning yarn from a fiber sliver, said method comprising the steps of:

automatically positioning a maintenance unit proximate the spinning stations for removing spinning components from spinning stations and replacing removed spinning components with replacement spinning components;

removing a spinning component via the maintenance unit from a spinning station for servicing;

replacing the removed spinning component via the maintenance unit with a replacement spinning component carried by the maintenance unit;

transferring the removed spinning component, via the maintenance unit, to a remote servicing station and servicing the removed spinning component; and installing, via the maintenance unit, the removed spinning component as a replacement spinning component at a spinning station at which a spinning component has been removed.

2. The method as in claim 1, including the step of maintaining a supply of spinning components at the servicing station greater than that required for operation of the spinning stations so that at least one replacement spinning component is available to replace spinning components that have been removed but not yet serviced.

3. The method as in claim 2, including the step of testing the removed spinning component after said servicing step and prior to said installing step.

4. The method as in claim 3, including the step of continuing service of the removed spinning component if malfunctions are detected at said testing step.

5. The method as in claim 4, wherein said testing step and said continued servicing step are repeated until no malfunctions are detected at said testing step, and wherein, if malfunctions are detected at said testing step after a predetermined number of repetitions, said testing step and said continued servicing step are not repeated and the removed spinning element is excluded from the supply of spinning components.

6. The method as in claim 1, wherein said removing step includes removing a plurality of spinning components from a spinning station, and wherein said replacing step includes replacing the plurality of spinning components with a plurality of replacement spinning components.

7. The method as in claim 1, wherein said servicing step includes cleaning the removed component.

8. The method as in claim 1, including the steps of monitoring the spinning stations prior to said automatic positioning step to detect malfunctions of the components and determining a sequence in which the malfunctioning components are to be removed for servicing responsively to detected malfunctions.

9. The method as in claim 1, including the steps of monitoring the time each spinning component is in operation at a said spinning station prior to said automatic positioning step since its most prior servicing and determining a sequence in which spinning components are to be removed for servicing responsively to the operation time.

10. The method as in claim 1, including the steps of storing the removed spinning component in an intermediate storage between said removing step and said servicing step and of storing the removed spinning component in an intermediate storage between said servicing step and said installing step.

11. A spinning machine system, said system comprising:

at least one spinning machine having a plurality of spinning stations, each spinning station comprising a plurality of spinning components and including one or more removable spinning components employed in spinning yarn from a fiber sliver; and a maintenance unit configured to travel along said at least one spinning machine proximate said spinning stations, said maintenance unit including a component storage area and a component handling mechanism configured to remove a said spinning component from a said spinning station for servicing, to place said removed spinning component in said component storage area, and to install a replacement spinning component from said component storage area at a said spinning station.

12. The system as in claim 11, wherein said spinning components are interchangeable.

13. The system as in claim 12, wherein a supply of said spinning components greater than that required for the operation of said spinning stations is maintained at a remote location accessible to said maintenance unit so that at least one said replacement spinning component is available to replace spinning components removed for servicing.

14. The system as in claim 11, including a service station, wherein said maintenance unit is configured to transport said removed spinning component to said service station, and wherein said service station is configured to service said removed spinning component.

15. The system as in claim 14, wherein said service station includes intermediate storage in which said removed spinning component are stored prior to servicing and in which said removed spinning component are stored after servicing and prior to installation as replacement spinning components.

16. The system as in claim 15, wherein each said spinning station includes a plurality of said spinning components and wherein said intermediate storage of said service station is configured to receive each of said plurality of said removable spinning components.

17. The system as in claim 14, wherein said maintenance unit storage area is configured to store a plurality of said removed spinning component for transport to said service station, and a replacement area for storing a plurality of said replacement spinning components that are to be installed at said spinning stations having had spinning components removed therefrom.

18. The system as in claim 14, wherein said service station includes a plurality of maintenance posts for servicing said removed spinning component.

19. The system as in claim 18, wherein each said maintenance post is configured to perform one or more service functions distinct from the service functions of other said maintenance posts.

20. The system as in claim 14, wherein said service station is configured to clean at least one of said one or more removable spinning components.

21. The system as in claim 14, wherein said service station includes a test station configured to test said removed spinning component serviced at said service station for proper operation prior to the installation of said removed spinning component as a replacement spinning component.

22. The system as in claim 21, wherein said service station includes a device for monitoring the operation of a spinning rotor.

23. The system as in claim 21, wherein said service station includes secondary storage to which a said removed spinning component that malfunctions at said testing station after repeated servicing at said service station are directed for removal from a supply of said spinning components.

24. The system as in claim 11, wherein each said spinning station includes an open-end spinning device, a bearing supporting said open-end spinning element, an opener device configured to open a fiber sliver for feeding to said open-end spinning device, and at least a portion of a feeding device configured to feed a fiber sliver to said opener device.

25. The system as in claim 24, wherein said open-end spinning device, said bearing, said opener, and said at least a portion of a feeding device comprise a single said spinning component.

26. The system as in claim 24, wherein said open-end spinning device, said bearing, said opener, and said at least a portion of a feeding device each comprise an individual said spinning component.

27. The system as in claim 24, wherein said open-end spinning device includes a spinning rotor and a rotor cover.

28. The system as in claim 11, wherein each said spinning station includes a spinning nozzle and at least a portion of a drafting mechanism upstream from said spinning nozzle.

29. The system as in claim 11, wherein each said spinning station includes a single said removable spinning component which is interchangeable.

30. The system as in claim 11, including a spinning machine control device configured to direct, responsively to the duration of operation of said spinning components at said spinning stations, said maintenance unit to remove certain of said spinning components for servicing.

31. The system as in claim 30, including a plurality of yarn monitors, wherein each said spinning station is associated with at least one said yarn monitor, wherein each said yarn monitor is configured to detect defects in the quality of yarn spun on its corresponding said spinning station, and wherein said spinning machine control device is configured to direct, responsively to defects detected by said yarn monitors, said maintenance unit to remove certain of said spinning components for servicing.

32. The system as in claim 30, including a plurality of spinning station control devices, each said spinning station control device associated with one of said spinning stations and configured to at least partially control the operation of its corresponding said spinning station, to store operating parameters of said spinning components capable of operation at said corresponding spinning station, to detect the operating parameters of any said spinning component installed at said corresponding spinning station, and to suspend operation of said corresponding spinning station when the operating parameters of any said spinning component installed at said corresponding spinning station fails to match the stored operating parameters.

33. The system as in claim 30, including a plurality of spinning station control devices, each said spinning station control device associated with one of said spinning stations and including a timing device configured to time the duration of operation of any said spinning component installed at said corresponding spinning station, wherein each said spinning station control device is configured to communicate, upon expiration of a predetermined operation period of said any spinning component installed at said corresponding spinning station, a maintenance signal to said spinning machine control device to initiate removal of said spinning component installed at said corresponding spinning station by said maintenance unit.

34. The system as in claim 11, wherein each said one or more removable spinning components is marked to indicate operating parameters thereof.

35. A method for maintaining at least one spinning machine having a plurality of spinning stations, each spinning station comprising plurality of spinning components and including one or more removable components employed in spinning yarn from a fiber sliver, said method comprising the steps of:

monitoring the spinning stations to detect malfunctions of the spinning components and to detect the time each spinning component is in operation at a spinning station since its most prior servicing;

determining a sequence in which the malfunctioning components are to be removed for servicing responsively to detected malfunctions and to the operation time;

automatically positioning a maintenance unit proximate the spinning stations for removing spinning components from spinning stations and replacing removed spinning components with replacement spinning components;

removing a spinning component via the maintenance unit from a spinning station for servicing;

replacing the removed spinning component via the maintenance unit with a replacement spinning component;

servicing the removed spinning component;

testing the removed spinning component;

installing, via the maintenance unit, the removed spinning component as a replacement spinning component at a spinning station at which a spinning component has been removed;

maintaining a supply of spinning components greater than that required for operation of the spinning stations so that at least one replacement spinning component is available to replace spinning components that have been removed but not yet serviced.

36. The method as in claim 35, including the steps of storing the removed spinning component in an intermediate storage between said removing step and said servicing step and of storing the removed spinning component in an intermediate storage between said servicing step and said installing step.

37. A spinning machine system, said system comprising:

at least one spinning machine having a plurality of spinning stations, each spinning station comprising a plurality of spinning components and including one or more interchangeable and removable spinning components employed in spinning yarn from a fiber sliver, wherein;

a service station configured to service said removed spinning component;

a maintenance unit configured to travel along said at least one spinning machine proximate said spinning stations and to transport said removed spinning component to said service station, said maintenance unit including a component storage area and a component handling mechanism configured to remove a said spinning component from a said spinning station for servicing, to place said removed spinning component in said component storage area, and to install a replacement spinning component at a said spinning station from which a removed spinning component was removed; and a spinning machine control device configured to direct, responsively to the duration of operation of said spinning components at said spinning stations, said maintenance unit to remove certain of said spinning components for servicing, wherein a supply of said spinning components greater than that required for the operation of said spinning stations is maintained so that at least one said replacement spinning component is available to replace spinning components removed for servicing.

38. The system as in claim 37, wherein each said spinning station includes a plurality of said spinning components and wherein said intermediate storage of said service station is configured to receive each of said plurality of said removable spinning components.

39. The system as in claim 37, wherein each said spinning station includes a single said removable spinning component which is interchangeable.

40. The system as in claim 37, including a plurality of spinning station control devices, each said spinning station control device associated with one of said spinning stations and including a timing device configured to time the duration of operation of any said spinning component installed at said corresponding spinning station, wherein each said spinning station control device is configured to communicate, upon expiration of a predetermined operation period of said any spinning component installed at said corresponding spinning station, a maintenance signal to said spinning machine control device to initiate removal of said spinning component installed at said corresponding spinning station by said maintenance unit.

* * * * *